US007516558B2

(12) United States Patent
Frank et al.

(10) Patent No.: US 7,516,558 B2
(45) Date of Patent: Apr. 14, 2009

(54) CEMENT-BASED TILE-SETTING SPACERS AND RELATED PROCESS

(76) Inventors: Keith Frank, P.O. Box 2556, Pagosa Springs, CO (US) 81147; Scott Gerling, 14816 Cullen St., Whittier, CA (US) 90603

( * ) Notice: Subject to any disclaimer, the term of this patent is extended or adjusted under 35 U.S.C. 154(b) by 0 days.

(21) Appl. No.: 11/456,812

(22) Filed: Jul. 11, 2006

(65) Prior Publication Data

US 2007/0011898 A1 Jan. 18, 2007

Related U.S. Application Data

(60) Provisional application No. 60/595,523, filed on Jul. 12, 2005.

(51) Int. Cl.
*G01B 1/00* (2006.01)

(52) U.S. Cl. ..... 33/526; 33/527; 33/518; 52/396.1; 52/677; 52/747.11

(58) Field of Classification Search ..... 33/526, 33/518, 527, 613, 645; 52/677, 396.1, 390, 52/389, 384, 747.11, 747.1, 747.12; D10/64; D25/199; 404/37

See application file for complete search history.

(56) References Cited

U.S. PATENT DOCUMENTS

| | | | | |
|---|---|---|---|---|
| 2,031,684 | A | 2/1936 | Berger | |
| 2,466,919 | A * | 4/1949 | Sykes | 33/526 |
| 2,930,135 | A | 3/1960 | Rodtz, Sr. | |
| 3,234,692 | A | 2/1966 | Bierlich | |
| 3,501,877 | A | 3/1970 | White | |
| 3,745,735 | A | 7/1973 | Casano | |
| 4,503,654 | A * | 3/1985 | Cosentino | 52/747.11 |
| 4,793,068 | A * | 12/1988 | Golkar | 33/526 |
| 4,862,668 | A | 9/1989 | Degooyer | |
| 4,953,341 | A | 9/1990 | Joos | |
| 5,010,654 | A | 4/1991 | Funes, Jr. | |
| 5,363,560 | A | 11/1994 | Makow | |
| 5,447,004 | A | 9/1995 | Vrnak | |
| 5,845,443 | A * | 12/1998 | Wirkus et al. | 52/308 |
| 6,223,972 | B1 | 5/2001 | Hanley | |
| 6,612,045 | B2 * | 9/2003 | Kruskamp | 33/526 |
| D492,210 | S * | 6/2004 | Shilo et al. | D10/64 |
| 6,823,640 | B1 | 11/2004 | Pytlewski | |
| 7,028,412 | B2 * | 4/2006 | Boomershine | 33/526 |
| 2002/0127374 | A1 * | 9/2002 | Spratling | 428/192 |
| 2005/0257468 | A1 | 11/2005 | Serros et al. | |

* cited by examiner

*Primary Examiner*—Christopher W Fulton
*Assistant Examiner*—Tania C Courson

(57) ABSTRACT

A spacer providing a substantially uniform space between adjacent tiles includes spacer legs extending radially from a common junction. The spacer legs, made from a porous material, are permanently adherable to a tile bonding material utilized to adhere the tiles to an underlying surface, and/or a grout material filling a gap between tiles. A process for making a tile spacer includes providing thinset material to which a liquid latex admix material is added. The materials are distributed evenly to a consistency of a damp fluffy sand-like mixture which is then placed into a mold of a desired shape and packed into the mold to bond the materials while still damp to form the tile spacer. The spacer is extracted from the mold and placed on a flat rigid sheet. The spacer is moist cured and dried at room temperature environment with 40-99% humidity.

13 Claims, 3 Drawing Sheets

CEMENT-BASED TILE-SETTING SPACERS AND RELATED PROCESS

BACKGROUND OF THE INVENTION

The present invention generally relates to spacers for maintaining uniform distances between tiles and the like. More particularly, the present invention relates to cementitious based tile setting spacers.

Ceramic tile is ubiquitous as a floor and/or wall covering in office, retail, residential and industrial spaces. However, laying out individual ceramic tiles in the positions that make up a chosen tile pattern is a costly process in terms of labor, expense and time.

Conventionally, a tile is set in a particular position in the tile pattern by applying a coat of thinset or the like to a surface the tile is going to be placed on. The individual tiles of the pattern are placed, side-by-side, in contact with the thinset. Typically, adjacent tiles are spaced apart from one another and, once the thinset under the tiles has cured, this space between the tiles is filled with grout to form sealed connections between the tiles. The grout adds to the ornamental appearance of the tile pattern and helps to prevent edges of the tiles from chipping. It is well-known for tile setters to use tile spacing devices, such as tile spacers, to create these spaces between the tiles as the tiles are being set in position.

Conventional tile spacers are typically made of plastic molded into various shapes including an X-shape (or cross-shape), a V-shape, a Y-shape and a T-shape. The spacers are inserted between adjacent tiles as the tiles are cemented to a floor or other surface. The spacers help the installer create and maintain uniform width between the adjacent tiles. Once the thinset has dried, the spacers are removed so that grout can be placed between the tiles. However, removal of the spacers is labor intensive, slow and can result in damage to the tiles. Attempts to simply leave the spacers in position and grout the spacers over have had poor results, causing the grout to appear discolored, lumpy, and even to crack and break due to poor bonding between the spacers and the grout. Thus, the spacers must be removed prior to grouting and this removal makes the process of installing tiles costly, in terms of labor, time and expense.

Accordingly, there is a need for a spacer that saves time and money by eliminating the tedious task of having to manually remove spacers prior to grouting. There is also a need for a spacer that can be left permanently imbedded in the thinset and grout. There is a further need to reduce and/or eliminate the risk of damaging tiles with a screwdriver or other tool when extracting spacers. There is a need to eliminate the tendency of spacers to work loose and crack the grout about them. There is also a need to increase productivity while decreasing labor costs. There is an additional need to offer a spacer in a wide range of sizes and configurations. There is a need for a spacer that will not harm or damage tile in any way. There is a need for a spacer usable by professional tile installers as well as do-it-yourself amateurs.

SUMMARY OF THE INVENTION

The present invention resides in a spacer and a process for making a spacer. The present invention provides spacers in a wide range of sizes and configurations and saves time and money by eliminating the tedious task of having to manually remove spacers prior to grouting as spacers embodying the present invention can be left permanently imbedded in the bonding materials (e.g., thinset, grout or the like) used to install tiles. This reduces and/or eliminates the risk of damaging tiles with a screwdriver or other tool that can occur when someone setting tiles attempts to extract spacers that need to be removed.

A spacer for providing a substantially uniform space between adjacent tiles generally comprises at least two spacer legs extending radially from a common junction. The spacer legs comprise a porous material permanently adherable to a tile bonding material utilized to adhere the tiles to an underlying surface, and/or a grout material filling a gap between the tiles. Each leg includes a recess at an end distal from the common junction. When properly installed, the spacer is disposed below an upper surface of the grout material.

The porous material may be selected from a variety of materials including, without limitation, the tile bonding material, the grout material, a cementitious material, a cement-based material, a thin set-based material, mortar adhesive, a bonding agent, a gel-based material, a granulated substance, or the like.

In a preferred embodiment, the tile bonding material comprises a first bonding material for adhering the tiles to the underlying surface and a second bonding material for filling the gap between the tiles.

Preferably, the at least two spacer legs comprise, at least in part, a variety of shapes including, without limitation, a linear shape, a V-shape, a Y shape, a T shape, a U shape, an L shape, an I shape, an X shape or the like. The spacer includes a line of weakness between the common junction and at least one of the legs for aiding in removal of the at least one leg from the spacer.

A process for making a tile spacer comprises, in general, providing a quantity of thinset material and adding a quantity of liquid latex, acrylic adhesive, or liquid admix material to the thinset material. In a preferred embodiment, one part latex admix material is mixed with six parts thinset material.

The thinset and admix materials are distributed evenly until the mixture of the materials ultimately achieve a desired consistency of damp fluffy sand-like mixture. In order to achieve the desired consistency, the thinset and admix materials are mixed together in a whipping manner.

The mixture is placed into a mold of a desired shape and packed into the mold to bond the materials while still damp in order to form a tile spacer. During packing of the mixture into the mold, compression is provided, ranging between 500 psi to 1000 psi of even pressure, to the mixture for about one second.

Once formed, the spacer is extracted from the mold and placed on a flat rigid sheet. Extraction may be achieved by pushing the spacer out of the mold.

The spacer is moist cured and dried at room temperature environment with 40-70% humidity. During curing, the spacer may be sprayed with a misting of water and covered with plastic. The spacer may also be placed in a room having approximately 99% humidity. Curing of the spacer also includes maintaining the spacer in a moist state for no less than 24 hours as well as constantly applying heat to the spacer ranging between 120 to 140 degrees Fahrenheit. During drying, the spacer is maintained in a room temperature environment with 40-70% humidity for about 12 hours.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
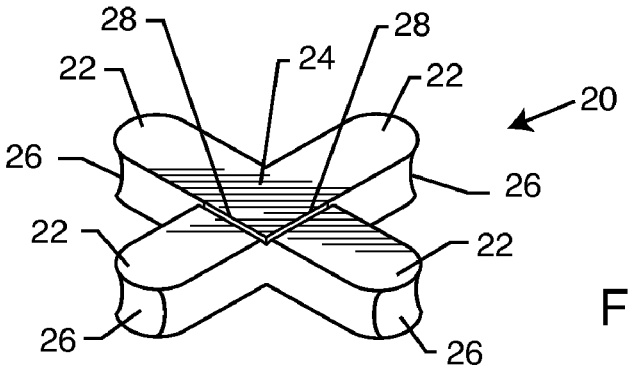
FIG. 1 is a perspective view of an X-shaped spacer embodying the present invention.

As seen in FIGS. 1-10, the present invention resides in a tile-setting spacer 20, 30, 40, 50, 60, 70, 80, 90. An X-shape spacer 20 includes four limbs or legs 22 extending radially outward from a common junction 24 to form the X-shape or cross-shape (approximate size being one inch by one inch in length and width, with a thickness of three sixteenths inch to one half inch). There is a slight, concave recess or cutout 26 at an end of each leg 12 distal from the common junction 24. However, in addition to the X-shaped spacer 20, a tile spacer can also come in a variety of other shapes including, without limitation, a linear shape 30 (FIG. 3), an L-shape 40 (FIG. 4), a V-shape 50 (FIG. 5), a Y-shape 60 (FIG. 6), a T-shape 70 (FIG. 7), a U-shape 80 (FIG. 8), an I-shape 90 (FIG. 9) or the like. Each spacer 30, 40, 50, 60, 70, 80, 90 includes a number of radial limbs or legs 32, 42, 52, 62, 72, 82, 92 extending radially outwardly from a common junction 34, 44, 54, 64, 74, 84, 94 to form the particular shape of the spacer 30, 40, 50, 60, 70, 80, 90. There is a slight, concave recess or cutout 36, 46, 56, 66, 76, 86, 96 at an end of each limb 32, 42, 52, 62, 72, 82, 92 distal from the common junction 34, 44, 54, 64, 74, 84, 94. Each spacer 20, 30, 40, 50, 60, 70, 80, 90 is made from a porous material that can be selected from a variety of materials including, without limitation, a cementitious material (formed by cement, silica sand, and a cement bonding agent), a cement-based material, a thin set-based material, and the same material as a tile bonding agent 100 used to set tiles 102 on a surface 104.

A number of spacers 20, 30, 40, 50, 60, 70, 80, 90 are used to provide a substantially uniform space 106 between the tiles 102 set on a surface 104. The spacers 20, 30, 40, 50, 60, 70, 80, 90 are meant to be left in place permanently once positioned between the tiles 102. Each spacer 20, 30, 40, 50, 60, 70, 80, 90 is hard, dry and solid when initially positioned between the tiles 102 but porous enough to bond with the tile bonding agent 100 and other materials (e.g., grout 108 used to fill in the space 106 between the tiles 102 and cover the spacers 20, 30, 40, 50, 60, 70, 80, 90). This allows each spacer 20, 30, 40, 50, 60, 70, 80, 90 and the tile bonding agent 100 to form a bond during the drying process of the tiles 102 with the tile bonding agent 100 and/or grout 108. Alternative materials from which the spacers 20, 30, 40, 50, 60, 70, 80, 90 may be made include, without limitation, a gel or granulated-type substance that will melt or merge into the tile bonding agent 100 after an allotted amount of time that is long enough to allow the tile 102 to bond with the surface 104. In another alternative, the tile spacer 20, 30, 40, 50, 60, 70, 80, 90 is made of grout 108 that is similar, if not identical, to the grout 108 used to cover the spacers 20, 30, 40, 50, 60, 70, 80, 90 and to fill in the spaces 106 between the tiles 102 that were created by the spacers 20, 30, 40, 50, 60, 70, 80, 90 to keep a uniform width of space 106 between adjacent tiles 102.

As illustrated with respect to several of the spacers 20, 60, 70, 90, a cut or line of weakness 28, 68, 78, 98 may be formed between the common junction 24, 64, 74, 94 and at least one of the legs 22, 62, 72, 92 for aiding in removal of the at least one leg 22, 62, 72, 92 from the spacer 20, 60, 70, 90. The line of weakness 28, 68, 78, 98 creates a structural weakness between the leg 22, 62, 72, 92 and the common junction 24, 64, 74, 94 that allows the leg 22, 62, 72, 92 to break from the spacer 20, 60, 70, 90 after an appropriate amount of force is applied. The line of weakness 28, 68, 78, 98 can come in various forms including, without limitation, an indent, a linear trough, a linear notch or other type of linear recess. The line of weakness 28, 68, 78, 98 allows an X-shaped spacer 20 to be converted into a T-shaped spacer 70 or a V-shaped spacer 50 (depending on the number of legs 22 removed), an I-shaped spacer 90 into a T-shaped spacer 70, a Y-shaped spacer 60 into a V-shaped spacer 50, a T-shaped spacer 70 into a linear spacer 30, etc. Although not illustrated, the remaining spacers 30, 40, 50, 80 may also have lines of weakness between the legs 32, 42, 52, 82 and the common junction 34, 44, 54, 84.

Figure 2:
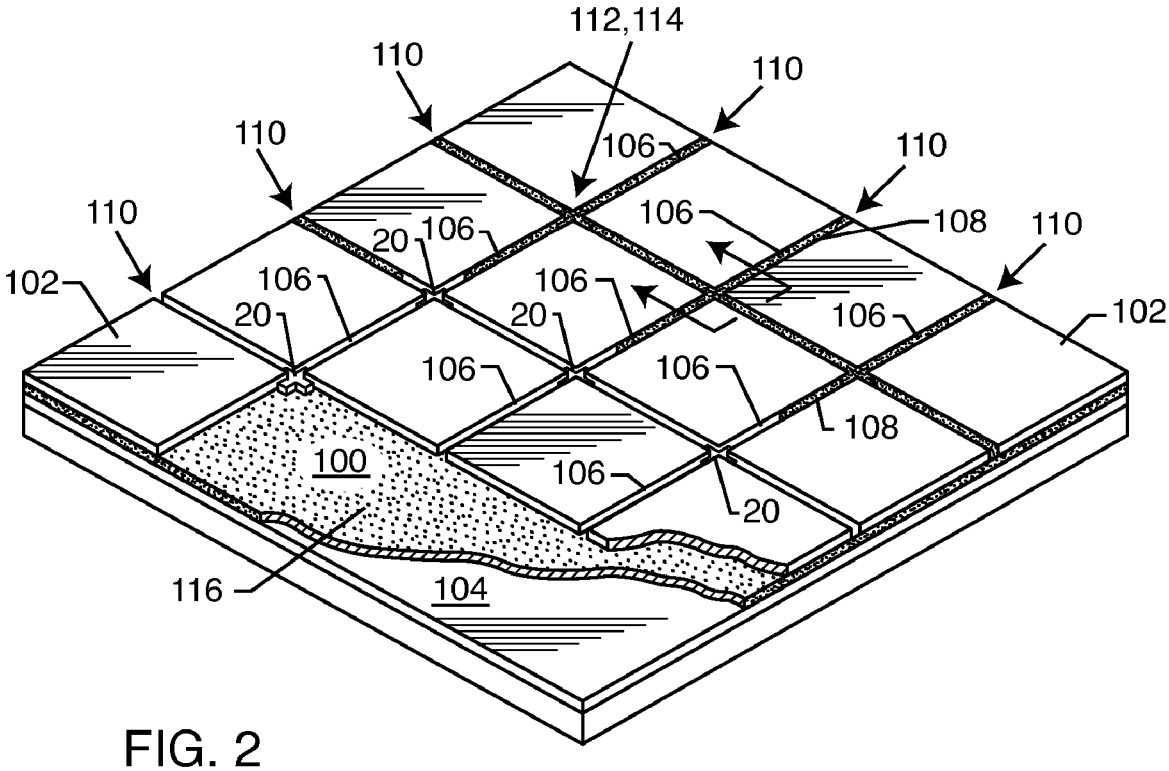
FIG. 2 is a perspective view of a number of the spacers of FIG. 1 being positioned between tiles on a floor.
Figure 3:
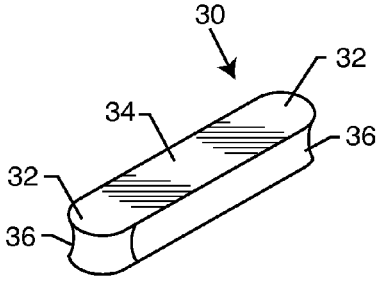
FIG. 3 is a perspective view of a linear-shaped spacer embodying the present invention.
Figure 4:
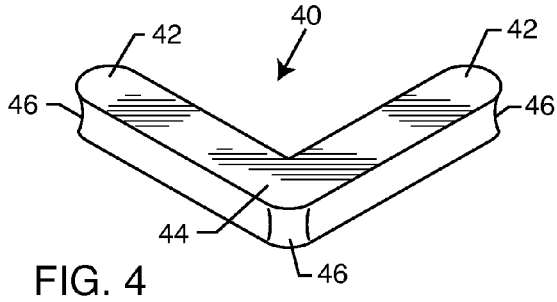
FIG. 4 is a perspective view of an L-shaped spacer embodying the present invention.
Figure 6:
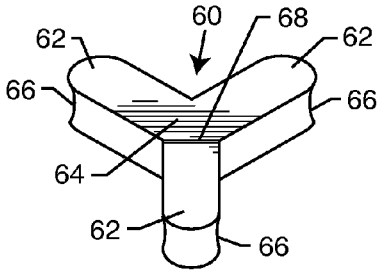
FIG. 6 is a perspective view of an Y-shaped spacer embodying the present invention.
Figure 5:
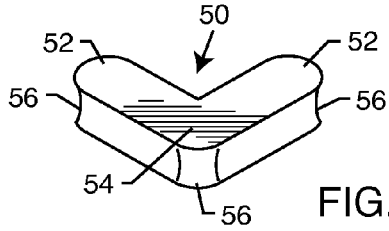
FIG. 5 is a perspective view of a V-shaped spacer embodying the present invention.
Figure 7:
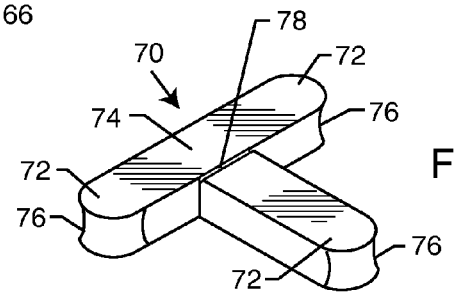
FIG. 7 is a perspective view of an T-shaped spacer embodying the present invention.
Figure 8:
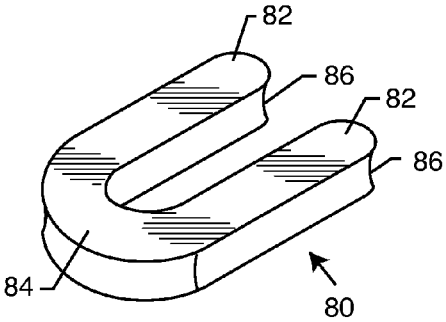
FIG. 8 is a perspective view of an U-shaped spacer embodying the present invention.
Figure 9:
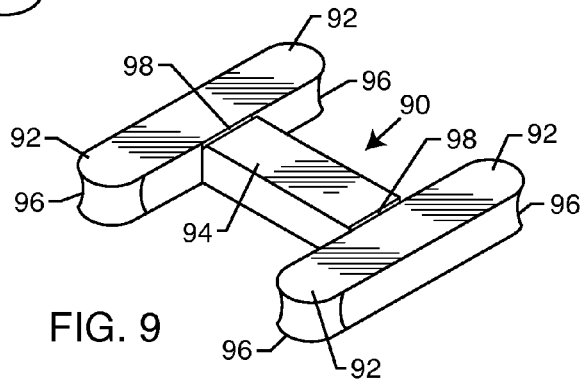
FIG. 9 is a perspective view of an I-shaped spacer embodying the present invention.
Figure 10:
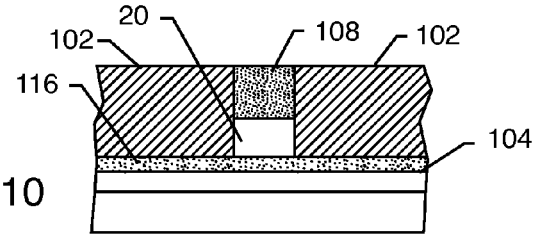
FIG. 10 is a sectional view of some tiles and a spacer taken along line 10-10 of FIG. 2.
Figure 11:
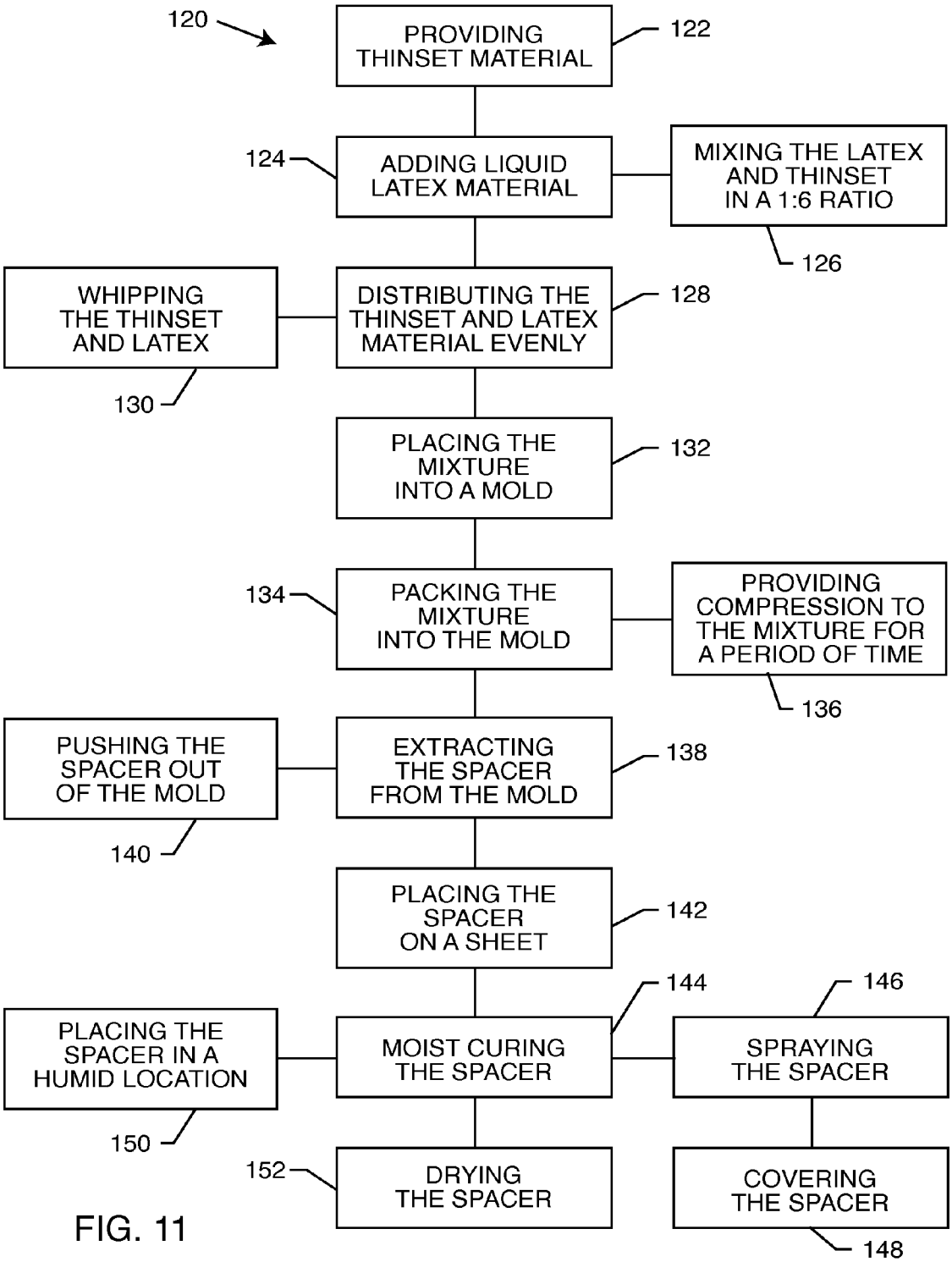
FIG. 11 is a flow chart illustrating a process for making a tile spacer.

An illustration of how tile spacers are used is shown in FIG. 2. An X-shaped spacer 20 is generally placed adjacent to each corner of a piece of rectangular or square-shaped tile 102 being set on the surface 104. The width of the spacer 20 is selected to be the same as the length of uniform space 106 desired between adjacent tiles 102. Once the tiles 102 have been attached to the surface 104, a suitable grout 108 is used to fill the space 106 between the tiles 102. The material of the spacers 20 allows the spacers 20 to partially merge with the tile bonding agent 100 so that the spacer 20 does not have to be removed prior to the grout 108 being applied to fill in the spaces 106 between the tiles 102 and cover the spacers 20. As seen in FIGS. 2 and 10, in order the cover the spacer 20 with grout 108, the height of the spacers 20 is less than the height of the tiles 102.

The spacers 20, 30, 40, 50, 60, 70, 80, 90 come in a variety of colors, such as white, brown or the like but the spacers 20, 30, 40, 50, 60, 70, 80, 90 can also be the same color as the grout 108 being used. The spacers 20, 30, 40, 50, 60, 70, 80, 90 can be made in a variety of sizes, such that the width of the legs 22, 32, 42, 52, 62, 72, 82, 92 of each spacer 20, 30, 40, 50, 60, 70, 80, 90 positioned between the tiles 102 can be any desired amount that matches the desired space 106 between the tiles 102. Thus, the legs 22, 32, 42, 52, 62, 72, 82, 92 can be of a variety of widths (including, but not limited to, one sixteenth inch, one quarter inch, three eighths inch, one half inch, five eighths inch, three quarter inch, seven eighths inch, one inch or more), lengths and heights.

As seen in FIG. 2, a coat of cement-based or thinset-based bonding agent 100 is applied to the underlying surface 104. Individual square ceramic tiles 102 are placed side-by-side in contact with the tile bonding agent 100 to define a series of a grid made of rows and columns such that the spaced-apart, adjacent tiles 102 define grooves 110 that are formed by the spaces 106 between the tiles 102. In order to maintain the spaces 106 between the tiles 102 and keep the spaces 106 of uniform width, a number of X-shape spacers 20 are inserted between the tiles 102. As seen in FIGS. 1 and 2, the X-shape of the spacer 20 is suitable for inserting the spacer 20 into an X-shaped space 112 formed at an intersection 114 of four tiles 102. However, the shape of the spacer 20, 30, 40, 50, 60, 70, 80, 90 selected to be used depends on the shape of the tile 102 being laid down and various spacers 20, 30, 40, 50, 60, 70, 80, 90 may be used with various shaped tiles 102 including, without limitation, trapezoidal, pentagonal, hexagonal, octagonal, circular, ovoid tiles 102 as the spacers 20, 30, 40, 50, 60, 70, 80, 90 are sized and shaped accordingly to provide the desired uniform space 106 between adjacent tiles 102 of such shapes.

In use, a first linear group of tiles 102 are applied to a layer 116 of the tile bonding material 100, a first bonding material, placed down along the surface (e.g., floor, ceiling, wall or the like) 104. As each tile 102 is positioned on the surface 104 (with the layer 116 of tile bonding agent 100 disposed between the tile 102 and the surface 104), a spacer 20 is placed at a corner of that tile 102 and an adjacent tile 102, into the X-shaped space 112 formed at the intersection 114 of the tiles 102, with the edges of the tiles 102 contacting the sides of the legs 22 of the spacer 20, creating the space 106 between the tiles 102. The spacer 20 contacts the layer 116 of tile bonding agent 100. Two more spacers 20 are placed at the corners of the second tile 102 and the positioning of additional tiles 102 is repeated in the manner described above. The spacers 20 join with the tile bonding layer 116. This results in tile 102 after tile 102 being laid down with spaces 106 of uniform width between the tiles 102. Likewise, another linear group of tiles 102 are positioned adjacent to the first linear group, applied to the bonding layer 116, and brought into contact with the spacers 20 at the corners of the first group of tiles 102 with the legs 22 of spacers 20 extending into the spaces 106 between the first and second linear groups of tiles 102. In this manner, rows and columns of square tiles 102 are secured to the underlying surface 104 with the spaces 106 between the tiles 102 separating the tiles 102 uniformly. By the time the tiles 102 have all been placed and the tile bonding agent 100 has dried, the spacers 20 will have merged/bonded with the tile bonding agent 100. The spaces 106 between the tiles 102 are filled with the grout material 108, a second bonding material, and the spacers 20 are covered with the grout material 108 to provide an attractive, water tight seal. The cutouts 26 of the legs 22 of the spacers 20 aid in allowing the grout 108 to bond to the spacers 20 as the grout 108 convexly fills in the space formed by the concave cutout 26.

Although the above use of the X-shaped spacer 20 has been described in the context of use with square or rectangular shaped tiles 102, the spacers 20, 30, 40, 50, 60, 70, 80, 90 may be used with tiles of various shapes including, without limitation, trapezoidal, pentagonal, hexagonal, octagonal, circular, ovoid or the like, and the spacers 20, 30, 40, 50, 60, 70, 80, 90 shaped accordingly to provide a desired space 106 between adjacent tiles 102 of such shapes.

A process 120 has been developed for making the tile spacers 20, 30, 40, 50, 60, 70, 80, 90 described above. In this example, the tile spacers 20, 30, 40, 50, 60, 70, 80, 90 are made from a thinset material base, which is also used as a tile bonding agent 100. Various types of thinset may be used including, without limitation, S.G.M. Southern Sanded Thinset #737/738 Dryset Portland Cement Mortar. A quantity of thinset material is provided 122 and a quantity of liquid latex admix material is added 124 to the thinset material. The thinset is mixed 126 with the latex liquid admix (e.g., S.G.M. Southcrete 35). The precise mixture of these two products have proven effective by mixing six parts thinset to one part latex admix. This is known as a "dry pack". The quantity of thinset and admix required to be used depends on the number of tile spacers desired to be made.

How the ingredients are mixed together is a critical part of the process 120. When the admix is added to the thinset 124, the liquid latex admix has a tendency to coagulate, or "ball up" in the dry thinset powder. After these components are mixed, it is necessary for the mixture to slake for 15 minutes. It is necessary to evenly distribute 128 both the thinset and the admix to the consistency of a damp fluffy sand-like mixture. To the naked eye, the mixture will look granulated and even. The even distribution of the mixture is accomplished by whipping 130 the two ingredients (i.e., the thinset and the admix) together with a paddle mixer, by hand or a mixing machine. If the mixture is too wet, the finished product (i.e., the spacer) appear concaved from the mixture having slumped during the process 120. This slumping occurs because, in the drying process discussed below, the moisture content of the admix evaporates, thus shrinking the resultant tile spacer. If the mix is too dry, the finished product will not be strong enough to withstand tension/compression, become flaky and shaley. Ideally, the finished tile spacer will feel like rock hard cement and be virtually impossible to break by hand, unless the spacer includes a line of weakness _, such as those discussed above.

Once the thinset and the admix are mixed together properly, the next step is to place 132 the damp mixture of these materials into a mold(s) of a desired shape. Each mold is shaped like the desired shape of a single tile spacer (i.e., an X-shape 20, a linear shape 30, an L-shape 40, a V-shape 50, a Y-shape 60, a T-shape 70, a U-shape 80, an I-shape 90 or the like). The mold is also referred to as a "cavity plate" and is made from various materials including, without limitation, an aluminum alloy, or other metal alloy. The cavity plate is one quarter inch thick and is similar in appearance to a cookie/biscuit mold in that the cavity plate generally comprises a thin piece of material in the desired shape forming a perimeter that defines an empty interior cavity into which the mixture is to be placed; the perimeter of the mold containing the mixture therein. The thickness of the finished spacer 20, 30, 40, 50, 60, 70, 80, 90 is three sixteenths of an inch or less. This will help insure that the spacer 20, 30, 40, 50, 60, 70, 80, 90 will be less of a thickness of an exposed tile. This also insures that a flow of "grout" 108 can flow over the top of the tile spacer 20, 30, 40, 50, 60, 70, 80, 90, thus burying it under the finished grout lines.

Underneath the cavity plate, there is a flat "cookie sheet" made from various materials including, without limitation, plastic, aluminum or the like. A plurality of cavity plates of the same shape may be used at the same time to make a number of spacers or various shaped cavity plates may be used at the same time to make a variety of different-shaped spacers.

The mixture must be packed 134 extremely tightly into the interior cavity of the cavity plate through compression to firmly bond the materials forming the mixture, and do so while the mixture of materials is still relatively wet. Compression is provided 136 to the mixture for a period of time. Compression of these materials is accomplished using various compression mechanisms including, without limitation, a hydraulic press, a mechanical press, by hand or the like. The down (i.e., compression) force necessary to compress the materials together properly ranges between 500 psi to 1000 psi of even pressure for a period of time (e.g., about one second).

In the hydraulic press, "ram pins" accomplish this task. Each ram pin is in the shape of the interior cavity of a particular cavity plate of a particular shape. Each ram pin is sized to fit within the cavity, with a tolerance of no more than fifteen thousandths of an inch smaller than the cavity's perimeter. The cavity plate and ram pin can be considered female/male counterparts to each other. The ram pin includes a linear protrusion to imprint the line of weakness in at least one leg 22, 32, 42, 52, 62, 72, 82, 92 of the spacer 20, 30, 40, 50, 60, 70, 80, 90 for aiding in removal of the at least one leg 22, 32, 42, 52, 62, 72, 82, 92 from the spacer 20, 30, 40, 50, 60, 70, 80, 90.

The next step is to extract 138 the compressed mixture being formed from the cavity plate. This extraction step process (i.e., where the still moist thinset/admix in the desired shape of the tile spacer is "de-molded" from the cavity plate), occurs nearly simultaneously with the compression step. While the down (i.e., compression) force is still being applied to compress the mixture in the cavity plate, the perimeter of the cavity plate itself is pushed upwardly, lifted from the bottom of the perimeter of the cavity plate such that the cavity plate is pushed upwardly around the ram pin. This action literally pushes 140 the spacer out of the cavity plate; de-molding the still-moist spacer from the cavity plate. As discussed above, there is a flat "cookie sheet" beneath the cavity plate. As the tile spacer(s) is de-molded, the tile spacer(s) "falls" a short distance (e.g., less than one half inch) into place on the cookie sheet 142. This completes the process of mixing, molding, and de-molding the tile spacer(s).

The next part of the process involves moist curing 144 the spacers. Immediately after the extraction/de-molding process, the spacer(s) must be either gently sprayed 146 with a misting of water, covered 148 with plastic or immediately placed 150 into a humid location (e.g., a room where the humidity is at approximately ninety nine percent (99%)). In either case, the freshly de-molded spacer(s) must be kept in a moist state for no less than twenty four hours. During this twenty four hour moist period, a constantly applied heat of 120-140 degrees Fahrenheit will complete and facilitate the curing process.

After the twenty four hour moist curing process is completed, the spacer(s) can be opened (i.e., removed from the plastic covering) and dried 152 in a room temperature environment with a humidity of between forty to seventy percent (40-70%) for about twelve hours. This will further harden/cure the spacer(s). At this point, the spacer(s) can be packaged and shipped as a finished product.

Although several embodiments have been described in detail for purposes of illustration, various modifications may be made to each without departing from the scope and spirit of the invention. Accordingly, the invention is not to be limited, except as by the appended claims.

What is claimed is:

1. A spacer for providing a substantially uniform space between adjacent tiles, comprising:

at least two spacer legs extending radially from a common junction, wherein the spacer legs comprise a porous material permanently adherable to a tile bonding material utilized to adhere the tiles to an underlying surface, and/or a grout material filling a gap between the tiles.

2. The spacer of claim 1, wherein each leg includes a recess at an end distal from the common junction.

3. The spacer of claim 1, wherein the porous material comprises the tile bonding material.

4. The spacer of claim 1, wherein the porous material comprises the grout material.

5. The spacer of claim 1, wherein the porous material comprises a cementitious material, a cement-based material, a thin set-based material, a bonding agent, a gel-based material, a granulated substance, or the grout material.

6. The spacer of claim 1, wherein the tile bonding material comprises a first bonding material for adhering the tiles to the underlying surface and a second bonding material for filling the gap between the tiles.

7. The spacer of claim 1, wherein the at least two spacer legs comprise, at least in part, a linear shape, a V-shape, a Y shape, a T shape, a U shape, an L shape, an I shape, or an X shape.

8. The spacer of claim 1, wherein the spacer is disposed below an upper surface of the grout material.

9. The spacer of claim 1, including a line of weakness between the common junction and at least one of the legs for aiding in removal of the at least one leg from the spacer.

10. A spacer for providing a substantially uniform space between adjacent tiles, comprising:

at least two spacer legs extending radially from a common junction, wherein the spacer legs comprise a porous material permanently adherable to a tile bonding material utilized to adhere the tiles to an underlying surface, and/or a grout material filling a gap between the tiles, the spacer being disposed below an upper surface of the grout material, and each leg includes a recess at an end distal from the common junction; wherein the porous material comprises the tile bonding material, the grout material, a cementitious material, a cement-based material, a thin set-based material, mortar adhesive, a bonding agent, a gel-based material, or a granulated substance.

11. The spacer of claim 10, wherein the tile bonding material comprises a first bonding material for adhering the tiles to the underlying surface and a second bonding material for filling the gap between the tiles.

12. The spacer of claim 10, wherein the at least two spacer legs comprise, at least in part, a linear shape, a V-shape, a Y shape, a T shape, a U shape, an L shape, an I shape, or an X shape.

13. The spacer of claim 10, including a line of weakness between the common junction and at least one of the legs for aiding in removal of the at least one leg from the spacer.

* * * * *